US009337527B2

(12) United States Patent
Yu et al.

(10) Patent No.: US 9,337,527 B2
(45) Date of Patent: May 10, 2016

(54) MOBILE TELECOMMUNICATION TERMINAL

(75) Inventors: Wei Yu, Waterloo (CA); Wen Li, Waterloo (CA)

(73) Assignee: Wen Li, Waterloo, Ontario (CA)

( * ) Notice: Subject to any disclaimer, the term of this patent is extended or adjusted under 35 U.S.C. 154(b) by 900 days.

(21) Appl. No.: 12/736,339

(22) PCT Filed: Mar. 31, 2008

(86) PCT No.: PCT/CN2008/000642

§ 371 (c)(1),
(2), (4) Date: Sep. 30, 2010

(87) PCT Pub. No.: WO2009/121205

PCT Pub. Date: Oct. 8, 2009

(65) Prior Publication Data

US 2011/0018779 A1 Jan. 27, 2011

(51) Int. Cl.

*H01Q 1/24* (2006.01)
*H01Q 9/42* (2006.01)
*H01Q 21/28* (2006.01)

(52) U.S. Cl.

CPC ..... *H01Q 1/243* (2013.01); *H01Q 1/245* (2013.01); *H01Q 9/42* (2013.01); *H01Q 21/28* (2013.01)

(58) Field of Classification Search

CPC ..... H01Q 1/243; H01Q 1/38; H01Q 9/0421
USPC ..... 343/702
See application file for complete search history.

(56) References Cited

U.S. PATENT DOCUMENTS

| | | | | |
|---|---|---|---|---|
| 2005/0043055 | A1* | 2/2005 | Vance | 455/550.1 |
| 2006/0017624 | A1* | 1/2006 | Nagano et al. | 343/702 |
| 2007/0164910 | A1* | 7/2007 | Qi et al. | 343/702 |
| 2007/0241972 | A1* | 10/2007 | Grossman et al. | 343/702 |
| 2007/0257853 | A1* | 11/2007 | Gevorgian et al. | 343/787 |
| 2011/0304512 | A1* | 12/2011 | Friederich et al. | 343/702 |

* cited by examiner

*Primary Examiner* — Dameon E Levi
*Assistant Examiner* — Collin Dawkins
(74) *Attorney, Agent, or Firm* — Steptoe & Johnson LLP

(57) ABSTRACT

A mobile communication terminal comprises a shell, and a backfire antenna which includes a main board disposed in the shell and having a transmitting circuit and a receiving circuit on the main board; a main antenna element coupled to the transmitting circuit and the receiving circuit on the main board; and a backfire resonator located at a side of the shell deviated from a user's head, and coupled to the main board and the main antenna element, in which the backfire resonator is fed by the main board from a position on the main board deviated from a center of the main board. The mobile communication terminal according to embodiment of the present disclosure may cause most electromagnetic waves to radiate towards a direction deviated form the user, thus reducing radiation and harm thereof to the user, strengthening the signal received by the base station, and improving the communication quality.

8 Claims, 11 Drawing Sheets

MOBILE TELECOMMUNICATION TERMINAL

This application is a national stage entry of International Application No. PCT/CN2008/000642, filed Mar. 31, 2008 designating the U.S.

TECHNICAL FIELD

The present disclosure generally relates to a mobile telecommunication terminal, more particularly, to a mobile telecommunication terminal such as a cell phone or a personal digital assistant (PDA) which can cause most radiation to deviate from the user thereof.

BACKGROUND

Generally, Mobile Network Operators want the mobile telecommunication terminal such as a cell phone and a personal digital assistant (PAD) with high ability to transmit and receive the signal, to ensure the quality of the signal transmitting and receiving. For example, many Mobile Network Operators measure and evaluate the signal transmitting signal and receiving ability of the cell phone using total radiated power (TRP) and total radiation sensitivity (TIS), in which TRP is used to evaluate the signal transmitting ability, and TIS is used to evaluate the signal receiving ability. The larger TRP of cell phones is, the larger the total radiation of the cell phone. Mobile Network Operators usually hope that the mobile telecommunication terminal has a large TRP, and a strong ability to transmit signals.

However, considering user's safety, it is hoped to reduce the harmful electromagnetic radiation of the cell phone to the user. When a user uses a cell phone, the cell phone is near the head of the user, particularly, the receiver is near the ear of the user. Radio waves transmitted from the cell phone to base station are more or less absorbed by the user, so that the health of the user may be hurt due to changing of the user's body tissue by the radio wave. In many countries, the radiation of the cell phone to the user must be less than the stipulated standards such as cell phone radiation absorption rate SAR (Specific Absorption Rate) Measurements. In North America and Europe, SAR testing is a mandatory standard, and the cell phone that does not satisfy the standard can not be sold in the market.

Hearing aid compatible (HAC) is another new measurement standard related to electromagnetic radiation of the cell phone. Because the cell phone may interfere with the a hearing aid, the user wearing the hearing aid may heard noise he should not hear, thus influencing the quality of the signal receiving. For the user wearing the hearing aid to use cell phone normally and ensuring the hearing impaired people to enjoy the same rights, HAC standards require the cell phone to operate with the hearing aid compatibly, and provide the measure methods and limit standard.

Cell phones are needed to have a strong signal transmitting ability (TRP meets the standard of the network operators), to have a low of radiation to users (SAR value is small), and to meet the requirements of HAC.

However, the conventional mobile telecommunication terminal such as cell phones can, not meet the standards and requirements without professional design.

SUMMARY

The present disclosure is directed to solve at least one of the problems exiting in the prior art.

Accordingly, a mobile communication terminal according to an embodiment of the disclosure is provided, which may cause most electromagnetic waves to radiate towards a direction deviated from or away from the user of the mobile communication terminal through the antenna arrangement, thereby reduce the electromagnetic radiation harm to the user.

The mobile communication terminal according to another embodiment of the disclosure may further enhance the signal intensity received by the base station, thus improving the communication quality.

According to an embodiment of the disclosure, the mobile communication terminal comprises: a shell, and a backfire antenna which includes: a main board disposed in the shell and having a transmitting circuit and a receiving circuit thereon; a main antenna element coupled to the transmitting circuit and the receiving circuit; and a backfire resonator located at a side of the shell deviated from a user's head, and coupled to the main board and the main antenna element, in which the backfire resonator is fed by the main board from a position on the main board deviated from a center of the main board.

According to further embodiments of the disclosure, the main antenna element is disposed adjacent to an end of the main board, and the position, from which the main board feeds the backfire resonator, is adjacent to the end of the main board.

The backfire resonator is fed by the main board through capacitive coupling or single feed coupling.

The main antenna element is disposed adjacent to one end of the main board, and the position on the main board, from which the main board feeds the backfire resonator, is adjacent to the other end of the main board opposite to the one end.

The backfire resonator is fed by the main board through dual feed coupling.

The backfire resonator is constituted by a plurality of conductors multistage-coupled.

The main antenna element is disposed adjacent to a lower end of the main board, and the backfire resonator is located in the shell at a back side of the main board, and fed by the main board through capacitive coupling or single feed coupling, and the position, from which the main board feeds the backfire resonator, is adjacent to the lower end of the main board.

The main antenna element is disposed adjacent to a lower end of the main board, and the backfire resonator is located in the shell at a back side of the main board and fed by the main board through dual feed coupling, and the position on the main board, from which the main board feeds the backfire resonator, is adjacent to an upper end of the main board.

The backfire resonator is disposed on a side surface or an end surface in the shell.

There are at least two backfire resonators constituting a backfire resonator array.

The main antenna element is disposed adjacent to a lower end of the main board, and the backfire resonator array is located in the shell at a back side of the main board and constituted by first and second backfire resonators.

A first distance between an upper end of the first backfire resonator and an upper end of the main board is larger than that between the main antenna element and a lower end of the first backfire resonator, a second distance between an upper end of the second backfire resonator and the upper end of the main board is smaller than that between the main antenna element and a lower end of the second backfire resonator, and the first backfire resonator is fed by the main board from a first position on the main board adjacent to the lower end of the main board through capacitive coupling or single feed coupling, and the second backfire resonator is fed by the main board from a second position on the main board adjacent to the upper end of the main board through dual feed coupling.

Alternatively, a first distance between an upper end of the first backfire resonator and an upper end of the main board is larger than that between the main antenna element and a lower end of the first backfire resonator, a second distance between an upper end of the second backfire resonator and the upper end of the main board is larger than that between the main antenna element and a lower end of the second backfire resonator, and the first and second backfire resonators are fed respectively by the main board from first and second positions on the main board adjacent to the lower end of the main board through capacitive coupling, single feed coupling, or dual feed coupling.

Further, a first distance between an upper end of the first backfire resonator and an upper end of the main board is smaller than that between the main antenna element and a lower end of the first backfire resonator, a second distance between an upper end of the second backfire resonator and the upper end of the main board is smaller than that between the main antenna element and a lower end of the second backfire resonator, and the first and second backfire resonators are fed respectively by the main board from first and second positions on the main board adjacent to the upper end of the main board through dual feed coupling.

The first and second backfire resonators are connected to each other by a metal conductor or coupled by a plurality of metal conductors multistage-coupled and disposed between the first and second backfire resonators.

The main antenna element is disposed adjacent to an upper end of the main board, and the backfire resonator array is located in the shell at a back side of the main board and constituted by the first and second backfire resonators.

A first distance between an upper end of the first backfire resonator and the main antenna element is smaller than that between a lower end of the main board and a lower end of the first backfire resonator, a second distance between an upper end of the second backfire resonator and the main antenna element is larger than that between a lower end of the main board and a lower end of the second backfire resonator, and the first backfire resonator is fed by the main board from a first position on the main board adjacent to the upper end of the main board through capacitive coupling or single feed coupling, and the second backfire resonator is fed by the main board from a second position on the main board adjacent to the lower end of the main board through dual feed coupling.

Alternatively, a first distance between an upper end of the first backfire resonator and the main antenna element is larger than that between a lower end of the main board and a lower end of the first backfire resonator, a second distance between an upper end of the second backfire resonator and the main antenna element is larger than that between a lower end of the main board and a lower end of the second backfire resonator, and the first and second backfire resonators are fed respectively by the main board from first and second positions on the main board adjacent to the lower end of the main board through dual feed coupling.

Further, a first distance between an upper end of the first backfire resonator and the main antenna element is smaller than that between a lower end of the main board and a lower end of the first backfire resonator, a second distance between an upper end of the second backfire resonator and the main antenna element is smaller than that between a lower end of the main board and a lower end of the second backfire resonator, and the first and second backfire resonators are fed respectively by the main board from first and second positions on the main board adjacent to the upper end of the main board through capacitive coupling or single feed coupling.

The first and second backfire resonators are connected to each other by a metal conductor, or coupled by a plurality of metal conductors multistage-coupled and disposed between the first and second backfire resonators.

The main antenna element is disposed adjacent to a lower end of the main board, and the backfire resonator array is located in the shell at a back side of the main board and constituted by first to fourth backfire resonators.

A first distance between an upper end of the first backfire resonator and an upper end of the main board is larger than that between the main antenna element and a lower end of the first backfire resonator and the main antenna element, a fourth distance between an upper end of the fourth backfire resonator and the upper end of the main board is larger than that between the main antenna element and a lower end of the fourth backfire resonator, a second distance between an upper end of the second backfire resonator and the upper end of the main board is smaller than that between the main antenna element and a lower end of the second backfire resonator, a third distance between an upper end of the third backfire resonator and the upper end of the main board is smaller than that between the main antenna element and a lower end of the third backfire resonator, and the first and fourth backfire resonators are fed respectively by the main board from first and fourth positions on the main board adjacent to the lower end of the main board through capacitive coupling or single feed coupling, and the second and third backfire resonators are fed respectively by the main board from second and third positions on the main board adjacent to the upper end of the main board through dual feed coupling.

The first and second backfire resonators are connected to each other by a first metal conductor, or coupled by a plurality of first metal conductors multistage-coupled and disposed between the first and second backfire resonators, and the third and fourth backfire resonators are connected to each other by a second metal conductor, or coupled by a plurality of second metal conductors multistage-coupled and disposed between the third and fourth backfire resonators.

The backfire resonator has any one of a straight line shape, a T-shape, a triangular shape, a L-shape, a J-shape, a trapezoidal shape, an I-beam shape, [illegible] and [illegible].

The metal conductor has any one of a straight line shape, a Z shape, a curved line shape and a zigzag shape.

With the mobile communication terminal according to embodiments of the present disclosure, most electromagnetic waves are radiated towards the direction deviated from or away from the user through the antenna arrangement, thus reducing the electromagnetic radiation harm to the user from mobile communication terminal in use, and it is beneficial to pass the SAR testing and HAC testing.

With the mobile communication terminal according to embodiments of the present disclosure, by causing most electromagnetic waves to radiate towards the direction deviated from the user, radiation to the user is reduced, and the strength of the received signal by base is improved, thus enhancing the communication quality such as speech quality.

With the mobile communication terminal according to embodiments of the present disclosure, the backfire resonator of the backfire antenna is not directly connected to the transmitting circuit and the receiving circuit on the main board, therefore, the backfire resonator will operate by cooperating with the main antenna element. In absence of the main antenna, the backfire resonator could not operate by itself. For example, the backfire resonator of the backfire antenna operates within a frequency band of BW1, the backfire resonator will influence the radiation direction of the whole backfire antenna in BW1, so that the mobile communication terminal radiates most radiation in BW1 towards the direction deviated from the user, thus reducing the radiation harm to the user.

With the mobile communication terminal according to embodiments of the present disclosure, the backfire resonator of the backfire antenna may be constituted by a plurality of conductors multistage-coupled, so that the backfire resonator of the backfire antenna is applicable for discontinuous structures.

With the mobile communication terminal according to embodiments of the present disclosure, the backfire resonator of the backfire antenna has a shape including a T-shape and its variants such as T, ⊽, ⊤. The backfire resonator of the backfire antenna is fed by the end of the main board, so that the physical length of the backfire resonator may be reduced effectively, and it is adapted for the miniaturization of mobile communication terminal.

With the mobile communication terminal according to embodiments of the present disclosure, the backfire resonator of the backfire antenna has a shape including a triangular shape and its variants such as ▼, ⧗, ⧖, thus expanding the bandwidth of the backfire resonator.

With the mobile communication terminal according to embodiments of the present disclosure, the backfire resonator of the backfire antenna has a shape including a L-shape, a J-shape, a trapezoidal shape, an I-beam shape, and their variants such as ⊻, ⊥, J, ⊃, ⊃, ⊃, so that the coupling effect between the backfire resonator and the main antenna is improved, and the bandwidth is expanded.

With the mobile communication terminal according to embodiments of the present disclosure, the backfire antenna may have a plurality of backfire resonators constituting a backfire resonator array, thus improving the ability and effects of radiating most electromagnetic waves deviated or turned aside from the user. The backfire resonator array is applicable for the mobile communication terminals of different structures, and capable of reducing the undesired radiation to the user.

With the mobile communication terminal according to embodiments of the present disclosure, the backfire resonator array is constituted by two backfire resonators. The main board feeds an end of one backfire resonator, in which the end of one backfire resonator is adjacent to the main antenna element, from a position adjacent to one end of the main board through capacitive coupling or single feed coupling, and the main board feeds an end of the other backfire resonator, in which the end of the other backfire resonator is adjacent to the main board, from another position on the main board adjacent to the other end of the main board. That is, the two backfire resonators are disposed in staggered positions, thus avoiding holding the two positions of the two backfire resonators simultaneously by the user, and reducing the disadvantages of the user's gripping.

With the mobile communication terminal according to embodiments of the present disclosure, the backfire resonators in the backfire resonator array may be connected to each other by a metal conductor, or coupled by a plurality of metal conductors multistage-coupled, thus improving the ability and effects of radiating most electromagnetic waves towards the direction deviated from or turned aside from the user. The metal conductor disposed in the backfire resonator array may be used to adjust and enhance the interaction between the backfire resonators, thus achieving better overall resonance.

As mentioned above, in the case of the two backfire resonators being disposed in staggered positions, the two backfire resonators are connected to each other by a metal conductor, or coupled by a plurality of metal conductors multistage-coupled. One backfire resonator far from main antenna element may be resonant with the other backfire resonator near the main antenna via the metal conductor, thus achieving better effects.

Additional aspects and advantages of the embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of the disclosure will become apparent and more readily appreciated from the following descriptions taken in conjunction with the drawings in which:

FIGS. 11A-11D are schematic views of the backfire resonator with a triangular shape and some variants thereof;

DETAILED DESCRIPTION

Figure 1:
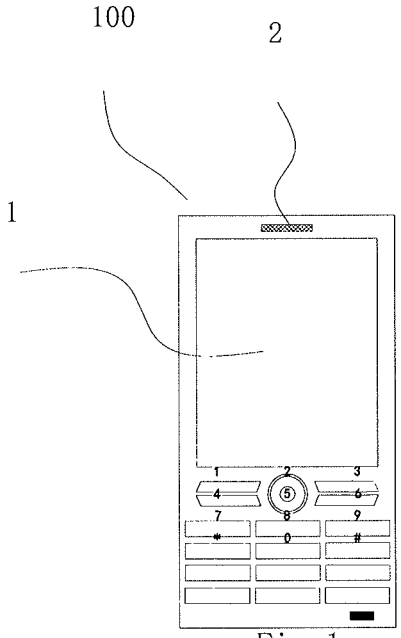
FIG. 1 is a schematic perspective view of a mobile communication terminal according to an embodiment of the present disclosure.

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

In the description, relative terms such as "longitudinal", "lateral", "front", "back", "right", "left", "lower", "upper", "top", "bottom" should be construed to refer to the orientation as then described or as shown in the drawings under discussion. These relative terms are for convenience of description and do not require that the present disclosure be constructed or operated in a particular orientation.

The mobile communication terminal according to an embodiment of the present disclosure will be described in detail with reference to the drawings below.

Figure 2:
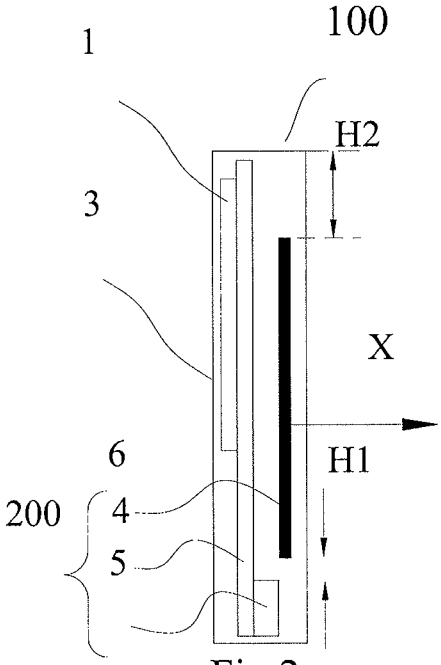
FIG. 2 is a schematic view of the antenna structure inside the mobile communication in FIG. 1.
Figure 4:
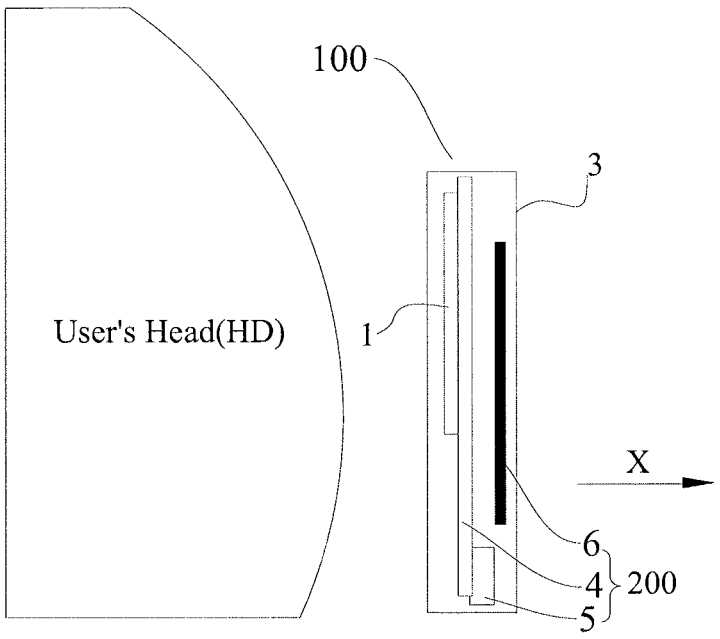
FIG. 4 is a schematic view of the mobile communication terminal in use with the shell removed in FIG. 2.

As shown in FIGS. 1 and 2, according to an embodiment of the present disclosure, the mobile communication terminal such as a cell phone 100 comprises a shell 3, a display screen (LCD) 1 disposed one the front side of the shell 3, a receiver disposed near the upper end of the shell 3 at the front side, and a variety of buttons disposed below the display screen 1. Further, the cell phone 100 comprises a backfire antenna 200 including a main board 4 such as the printed circuit board (PCB) disposed in the shell 3 and having a transmitting circuit 101 and a receiving circuit 102 thereon; a main antenna element 5 connected to the transmitting circuit 101 and the receiving circuit 102 on the main board 4; and a backfire resonator 6 disposed in the shell at a side deviated from or turned aside from a user's head (HD) (as shown in FIG. 4), and coupled to the main board 4 and the main antenna element 5 respectively, in which the backfire resonator 6 is fed by the main board 4 from a position on the main board 4 deviated from a center of the main board 4. In other words, the main board 4 supplies power to the backfire resonator 6 from a position thereon deviated or offset from the center thereof.

The backfire resonator 6 and the main board 4 as well as the main antenna element 5 constitute the backfire antenna 200 of the cell phone 100 by disposing the backfire resonator 6 in the shell 3 at a side deviated from or turned aside from the user's head HD. Because of the presence of the backfire resonator 6, the electromagnetic waves radiated from the main antenna element 5 are coupled to the end of the backfire resonator 6. Accordingly, the main antenna element 5 radiate most electromagnetic waves towards the X direction waves turned aside from the user's head HD through, but not limited to, the reflection of the main board 4. Therefore, it may reduce the radiation and harm thereof to the user's head HD in use of the cell phone 100, and improve the strength of signal received by base station and the communication quality such as the speech quality. For example, the backfire resonator 6 of the backfire antenna 200 operates within a predetermined frequency band of BW1, the presence of the backfire resonator 6 affects the direction of the radiation of the whole backfire antenna 200 in the predetermined frequency band mentioned above, so that the cell phone radiates most radiation towards the X direction turned aside from the user in the band BW1, thus reducing the radiation harm to the user. Despite that, it should be noted that the backfire resonator 6 can not operate by itself if there is no main antenna element 5.

It should be noted that the X direction in FIG. 2 indicates the direction along which the cell phone 100 in use is deviated from the user's head HD. However, the X direction may be other directions deviated or turned aside from the user's head HD, such as the top direction of the shell 3, the bottom direction of the shell 3 or the side directions of the shell 3. Of course, the X direction shown in FIGS. 2 and 4 (the backward direction of the shell 3) is a preferable direction. As long as the X direction is deviated or turned aside from the user's head, the radiation and the harm thereof to the user can be reduced. Therefore, X direction is only a schematic direction, it may be many directions that deviated from the user's head HD, and may not be as shown in FIGS. 2 and 4.

Although the backfire resonator 6 is disposed at the back side of the main board 4 in FIGS. 2 and 4, the backfire resonator 6 may be disposed at the top side, the bottom side or any one of the two sides of the shell 3, and detailed descriptions thereof are omitted here.

Figure 3:
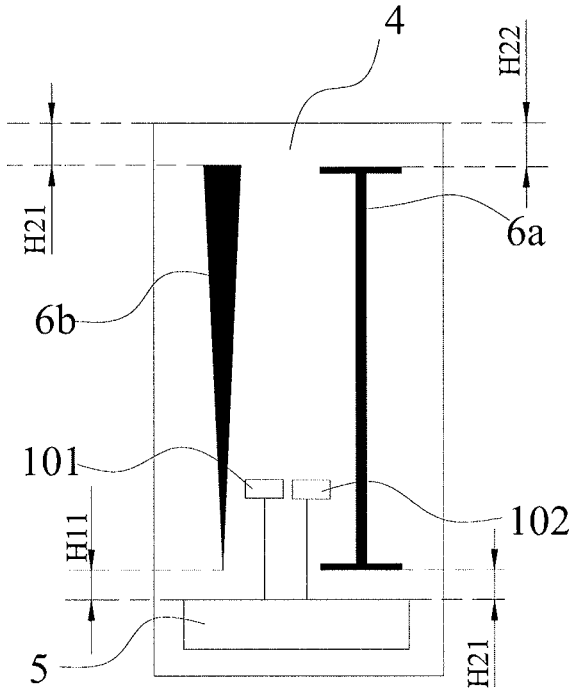
FIG. 3 is a back view of the mobile communication terminal with the shell removed in FIG. 2.
Figure 5:
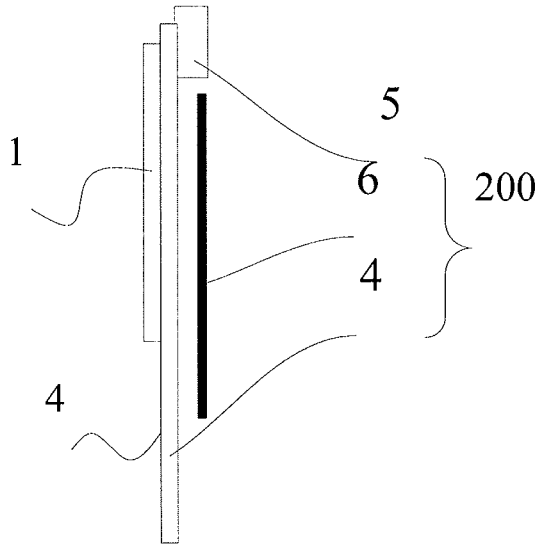
FIG. 5 is a schematic view of the mobile communication terminal with the main antenna located adjacent to the top of the shell.

As shown in FIG. 3, there are two the backfire resonators 6 constituting a backfire resonator array, and detailed description thereof will be given below. As shown in FIGS. 2-4, the main antenna element 5 is disposed adjacent to the lower end the main board 4 (i.e., the shell 3). Of course, as shown in FIG. 5, the main antenna element 5 may be disposed adjacent to the upper end of the main board 4.

Figure 6:
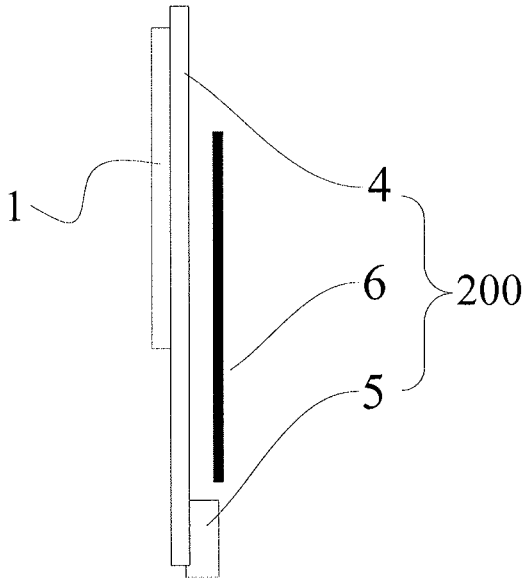
FIG. 6 is a schematic view showing the backfire resonator is fed by the main board through capacitive coupling.
Figure 7:
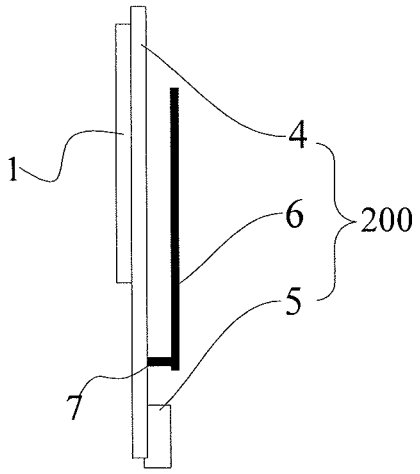
FIG. 7 is a schematic view showing the backfire resonator is fed by the main board through single feed coupling.
Figure 8:
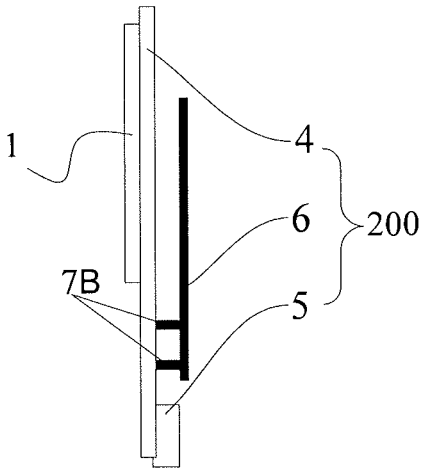
FIG. 8 is a schematic view showing the backfire resonator is fed by the main board through dual feed coupling.

FIGS. 6 to 8 show manners by which the backfire resonator 6 is fed by the main board 4. As shown in FIG. 6, a distributed capacitance is formed between the backfire resonator 6 and the main board 4. The backfire resonator 6 is fed by the main board 4 through capacitive coupling. Although the main board 4 feeds the backfire resonator 6 by the whole distributed capacitance formed between the backfire resonator 6 and the main board 4, the distributed capacitance at the feeding position (such as the position near the top of the backfire resonator 6) between the backfire resonator 6 and the main board 4 may be intentionally increased, so that the effect of the capacitive coupling may be enhanced.

According to an embodiment of the present disclosure, the main board 4 feeds the backfire resonator 6 from the position on the main board 4 adjacent to one end of the main board 4, that is, the main board 4 supplies power to the end of the backfire resonator 6.

As shown in FIG. 7, the backfire resonator 6 is fed by the main board 4 through the single feed coupling 7. Here, so-called "single feed coupling" refers to that the main board 4 is coupled to the backfire resonator 6 through a single metal conductor. As shown in FIG. 8, the backfire resonator 6 is fed by the main board 4 through dual feed coupling 7B. Here, so-called "dual feed coupling" refers to that the main board 4 is coupled to the backfire resonator 6 through two metal conductors.

Figure 9:
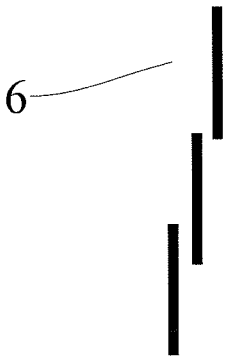
FIG. 9 is a schematic view of the backfire resonator constituted by a plurality of conductors multistage-coupled.
Figure 10A:
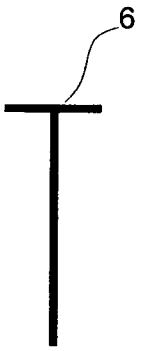
FIGS. 10A-10D are schematic views of the backfire resonator with a T-shape and some variants thereof.
Figure 10B:
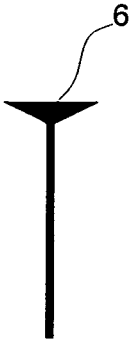
Figure 10C:
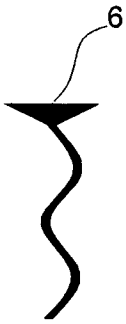
Figure 10D:
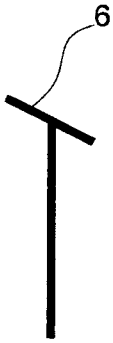
Figure 11A:
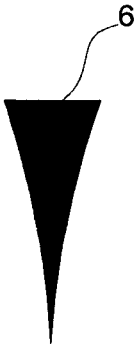
Figure 11B:
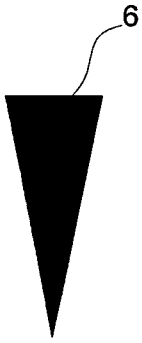
Figure 11C:
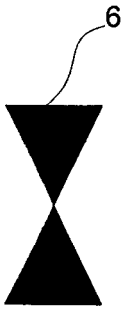
Figure 1D:
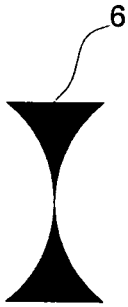

The backfire resonator 6 may have various shapes. For example, as shown in FIG. 9, the backfire resonator 6 is constituted by a plurality of conductors multistage-coupled. The plurality of conductors are connected end to end. FIG. 6 shows that there are three conductors. However, the number of the conductors is not limited to three. The backfire resonator 6 constituted by a plurality of conductors multistage-coupled is applicable for a discontinuous structure. That is, the plurality of conductors constituting the backfire resonator 6 may be disposed on a discontinuous structure so as to increase flexibility and applicability.

FIGS. 10A-10D are schematic views showing the backfire resonator 6 has a T-shape and some variants thereof, in which the backfire resonator 6 having a T-shape is fed at the top end thereof, thus reducing the physical length of the backfire resonator effectively, and being adapted for the miniaturization of mobile communication terminal.

FIGS. 11A-11D are schematic views showing the backfire resonator 6 has a triangular shape and some variants thereof, in which the backfire resonator 6 having such shapes may broaden the bandwidth of the backfire resonator 6, thus being applicable for a broader frequency band.

Figure 12A:
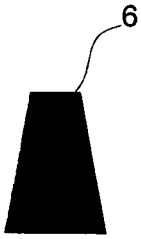
FIGS. 12A-12B are schematic views of the backfire resonator with a trapezoidal shape and a variant thereof.
Figure 12B:
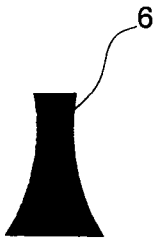
Figure 13A:
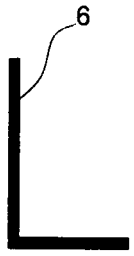
FIGS. 13A-13C are schematic views of the backfire resonator with a L-shape and some variants thereof.
Figure 13B:
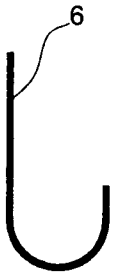
Figure 13C:
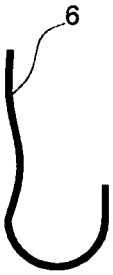
Figure 14A:
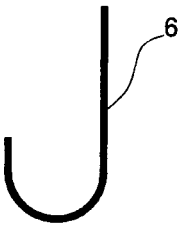
FIGS. 14A-14B are schematic views of the backfire resonator with a J-shape and a variant thereof.
Figure 14B:
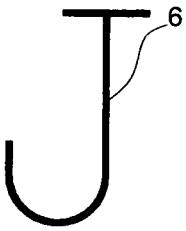
Figure 15A:
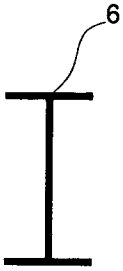
FIGS. 15A-15C are schematic views of the backfire resonator with a I-beam shape and some variants thereof.
Figure 15B:
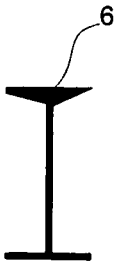
Figure 15C:
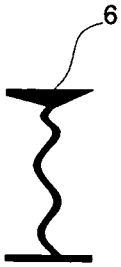

FIGS. 12A-12B are schematic views showing the backfire resonator 6 has a trapezoidal shape and some variants thereof. FIGS. 13A-13C are schematic views showing the backfire resonator 6 has a L-shape and some variants thereof. FIGS. 14A-14B are schematic views showing the backfire resonator 6 has a J-shape and some variants thereof. FIGS. 15A-15C are schematic views showing the backfire resonator 6 has a I-beam shape and some variants thereof. By using the backfire resonator having the above shapes, the effects of the coupling between the backfire resonator and the main antenna may be enhanced effectively, and the bandwidth may be expanded.

Although the specific shapes of the backfire resonator 6 are shown and described, it should be noted that the shape of the backfire resonator 6 is not limited to those mentioned above. The backfire resonator 6 may be of any suitable shape. In addition, the backfire resonator 6 having the shapes mentioned above may be made by a metal sheet or flexible PCB (FPC) and mounted onto the other components of the cell phone, for example, mounted at the inside of the back of the shell 3. Alternatively, the backfire resonator 6 may be formed on the other components of the cell phone 100 by electroplating a plating film at the inside of the back of the shell 3.

It should be noted that although the backfire resonator 6 is not shown to be connected to the other components of the cell phone in the figures, in actual use, the backfire resonator 6 may be disposed on the other components of the cell phone 100 through many known methods. For example, the backfire resonator 6 is disposed on the inside of the back of the shell 3, and detail descriptions are omitted here.

According to an embodiment of the present disclosure, the backfire resonator 6 is located at a back side of the main board 4 along a longitudinal direction (the upper and lower direction in FIGS. 1 to 4). When the main antenna element 5 is disposed adjacent to one end (for example, the lower end) of the main board 4, and the lower distance H1 between the main antenna element 5 and an end of the backfire resonator 6 adjacent to the main antenna element 5 is smaller than the upper distance H2 between the other end of the backfire resonator 6 and the other end of the main board 4, the main board 4 feeds the end of backfire resonator 6 adjacent to the main antenna element 5 from the one end thereof through capacitive coupling or single feed coupling. Further, if H1 is larger than H2, the main board 4 feeds the other end of the backfire resonator 6 from the other end thereof through dual feed coupling 7B.

In brief, if the backfire resonator 6 is fed by the main board 4 from an end of the main board adjacent to the main antenna element 5, the main board 4 may feed the backfire resonator 6 through capacitive coupling, single feed coupling or dual feed coupling. If the backfire resonator 6 is fed by the main board 4 from the other end of the main board 4 far away from the main antenna element 5, the main board 4 feeds the backfire resonator 6 preferably through dual feed coupling 7B. However, it should be noted that the present disclosure is not limited to above.

As shown in FIGS. 16A-16B, 17A-17B, 18A-18B, 19A-19B, 20A-20B, 21A-21B, the backfire resonator 6 is configured that at least two backfire resonators 6 are arranged as a backfire resonator array. By configuring the backfire resonator array by a plurality of backfire resonators, it may enhance the effects of making most electromagnetic waves radiate towards the direction deviated from or turned aside from the head of the user, and thereby reducing radiation and the harm thereof to the user. In addition, the strength of the signal received by base is increased, thus enhancing the communication quality. The backfire resonator array may be formed in many manners, and examples of the backfire resonator array will be described hereinafter by referring to drawings.

Figure 16A:
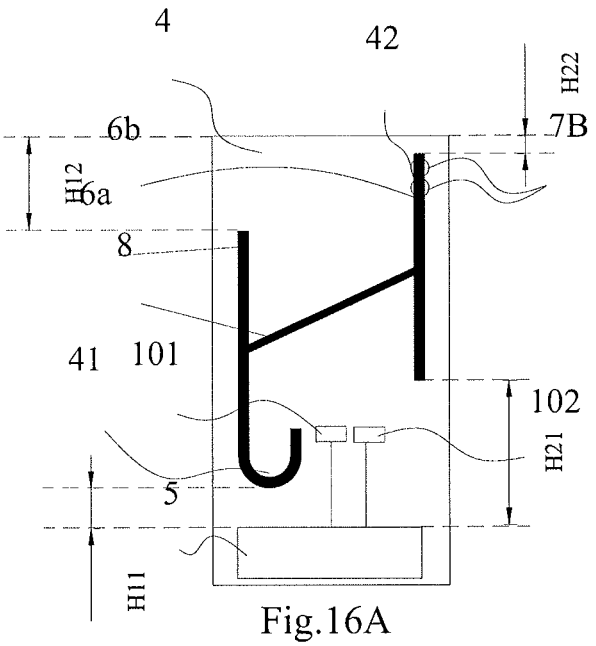
FIGS. 16A-16B are schematic views showing that the main antenna element is installed adjacent to the lower end of the main board, in which two backfire resonators connected to each other by a metal conductor constitute a backfire resonator array, and the main board feeds one backfire resonator adjacent to the main antenna element through capacitive coupling, and feeds the other backfire resonator adjacent to the upper end of the main board through dual feed coupling.
Figure 16B:
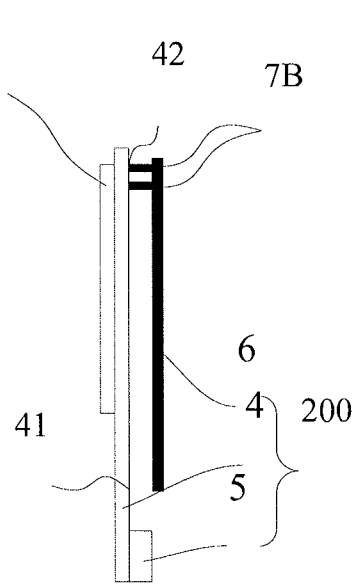

As shown in FIGS. 16A-16B, the main antenna element 5 is disposed adjacent to a lower end of the main board 4. The backfire resonator array includes a first backfire resonator 6*a* and a second backfire resonator 6*b* located at a side of the back of the main board 4, and the first and second backfire resonators 6*a* and 6*b* are connected to each other by a metal conductor 8 made by a metal sheet or FPC.

A first distance H12 between an upper end of the first backfire resonator 6*a* and an upper end of the main board 4 is larger than that H11 between the main antenna element 5 and a lower end of the first backfire resonator 6*a*, so that the first backfire resonator 6*a* is fed by the main board 4 from a first position 41 on the main board adjacent to the lower end of the main board 4 through capacitive coupling.

A second distance H22 between an upper end of the second backfire resonator 6*b* and the upper end of the main board 4 is smaller than that H21 between the main antenna element 5 and a lower end of the second backfire resonator 6*b*, so that the second backfire resonator 6*b* is fed by the main board 4 from a second position 42 on the main board adjacent to the upper end of the main board 4 through dual feed coupling 7B.

By constituting the backfire resonator array by the backfire resonators 6, it may enhance the effects of making most electromagnetic waves radiate towards the direction deviated from the user's head HD, thus reducing radiation and harm thereof to the user.

Figure 17A:
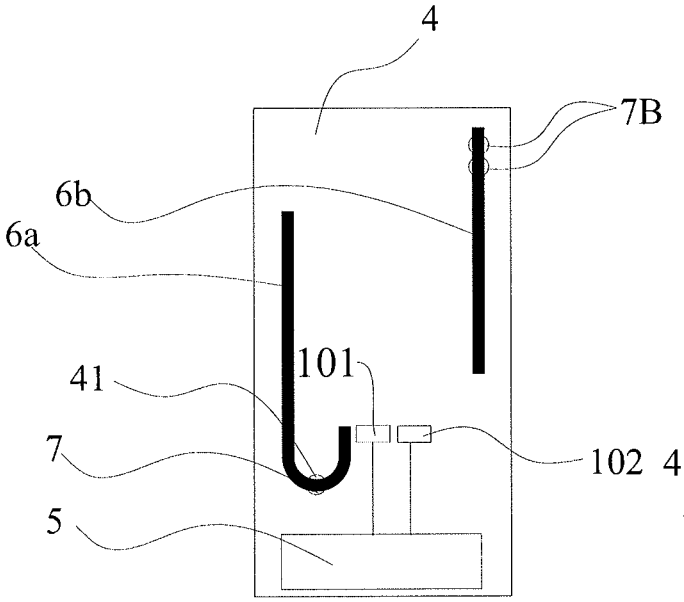
FIGS. 17A-17B are schematic views showing that the main antenna element is installed adjacent to the lower end of the main board, in which two backfire resonators connected to each other constitute a backfire resonator array, and the main board feeds one backfire resonator adjacent to the main antenna element through single feed coupling, and feeds the other backfire resonator adjacent to the upper end of the main board through dual feed coupling.
Figure 17B:
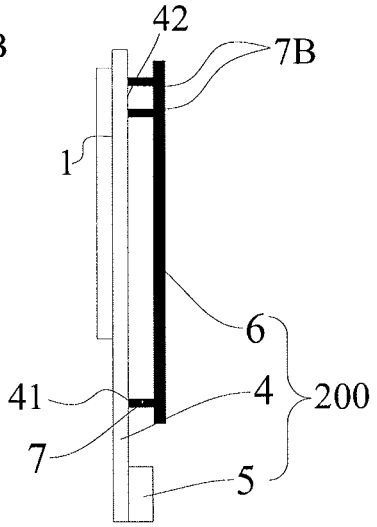

As shown in FIGS. 17A-17B, the first backfire resonator 6*a* and second backfire resonator 6*b* may not be connected to each other by a metal conductor, and the first backfire resonator 6*a* is fed by the main board 4 from a first position on the main board adjacent to the lower end of the main board 4 through single feed coupling 7, and the others shown in FIGS. 17A-17B may be the same as those shown in FIGS. 16A-16B, so that descriptions thereof are omitted here.

Figure 18A:
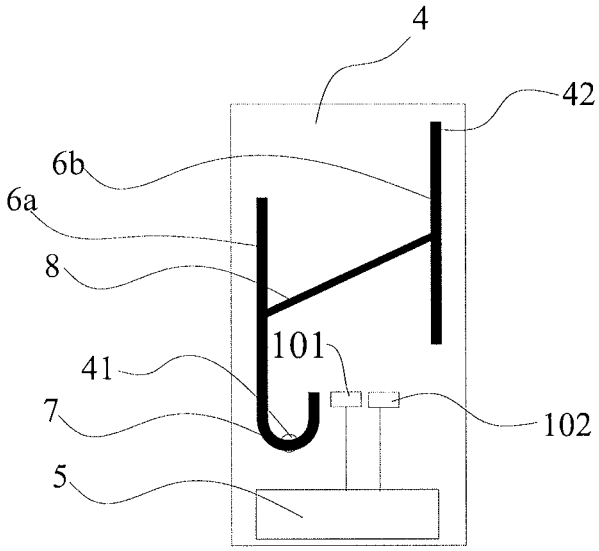
FIGS. 18A-18B are schematic views showing that the main antenna element is installed adjacent to the lower end of the main board, in which two backfire resonators connected to each other by a metal conductor, in which the main board feeds one backfire resonator adjacent to the main antenna element through signal feed coupling, and feeds the other backfire resonator through capacitive coupling.
Figure 18B:
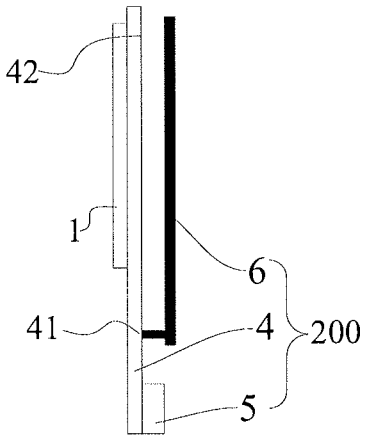

As shown in FIGS. 18A-18B, the first backfire resonator 6*a* is fed by the main board 4 from a first position on the main board adjacent to the lower end of the main board 4 through single feed coupling 7. The second backfire resonator 6*b* is near the upper end of the main board 4. The second backfire resonator 6*b* is fed by the main board 4 from a second position on the main board adjacent to the upper end of the main board 4 through capacitive coupling. A metal conductor 8 may be disposed between the first and second backfire resonators 6*a*, 6*b*. The metal conductor 8 may be one ore most, and the metal conductors 8 may be multistage-coupled so as to be applicable to the discontinuous structure, thus making the first backfire resonator 6*a* and second backfire resonator 6*b* resonant with each other, and the others shown in FIGS. 18A-18B are the same as those shown in FIGS. 16A-16B, so that descriptions thereof are omitted here.

Figure 20A:
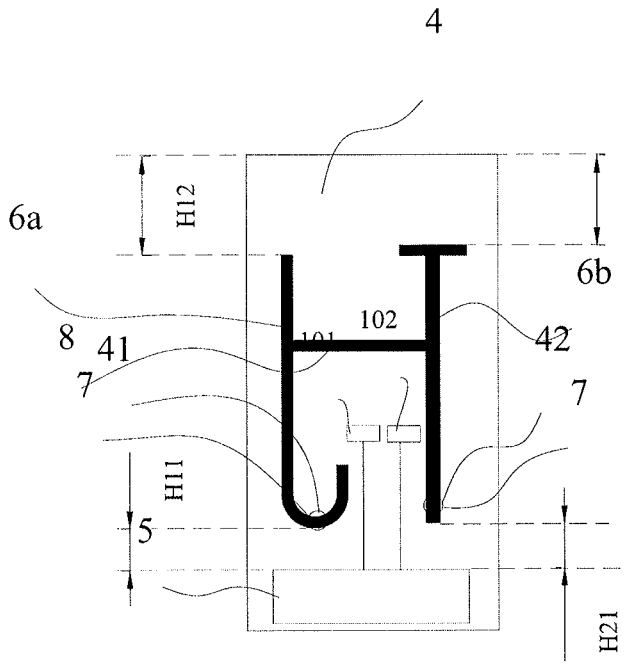
FIGS. 20A-20B are schematic views showing that the main antenna element is installed adjacent to the lower end of the main board, in which two backfire resonators connected to each other by a metal conductor constitute a backfire resonator array, and the main board feeds two backfire resonators which are both adjacent to the main antenna element through single feed coupling.
Figure 20B:
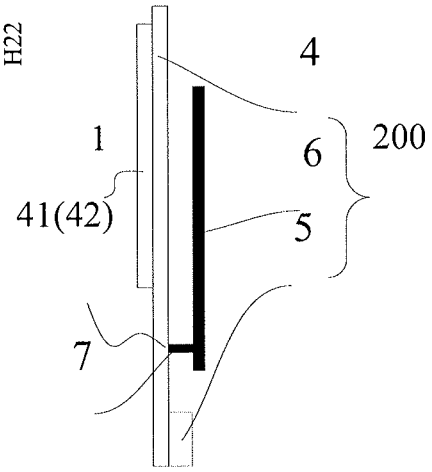

As shown in FIGS. 20A-20B, the main antenna element 5 is disposed adjacent to a lower end of the main board 4, the backfire resonator array includes the first backfire resonator 6*a* and the second backfire resonator 6*b*, and the first and second backfire resonators 6*a* and 6*b* are connected to each other by a metal conductor 8. A first distance H12 between an upper end of the first backfire resonator 6*a* and an upper end of the main board 4 is larger than that a H11 between the main antenna element 5 and a lower end of the first backfire resonator 6*a*. A second distance H22 between an upper end of the second backfire resonator 6*b* and the upper end of the main board 4 is larger than that H21 between the main antenna element 5 and a lower end of the second backfire resonator 6*b*. The first and second backfire resonators 6*a*, 6*b* are fed respectively by the main board 4 from first and second positions 41 42 on the main board adjacent to the lower end of the main board 4 through single feed coupling.

In the embodiments as shown in FIGS. 16A-16B, 17A-17B, 18A-18B, the shape of the first backfire resonator 6*a* is a variant of the L-shape, and the shape of the second backfire resonator 6*b* is a straight line. In the embodiments as shown in FIGS. 20A-20B, the shape of the first backfire resonator 6*a* is a variant of the L-shape, and the second backfire resonator 6*b* has a substantially T-shape.

It should be noted that the shapes of the first backfire resonator 6*a* and the second backfire resonator 6*b* can be combined in any suitable manners, and the combinations thereof is not limited to those shown in the above drawings.

Although being not shown, the first distance H12 between an upper end of the first backfire resonator 6*a* and an upper end of the main board 4 may be smaller than that H11 between the main antenna element 5 and a lower end of the first backfire resonator 6*a*, and the second distance H22 between an upper end of the second backfire resonator 6*b* and the upper end of the main board 4 may be smaller than that H21 between the main antenna element 5 and a lower end of the second backfire resonator 6*b*. The first and second backfire resonators 6*a*, 6*b* may be fed respectively by the main board 4 from first and second positions on the main board adjacent to the upper end of the main board 4 through dual feed coupling.

Figure 21A:
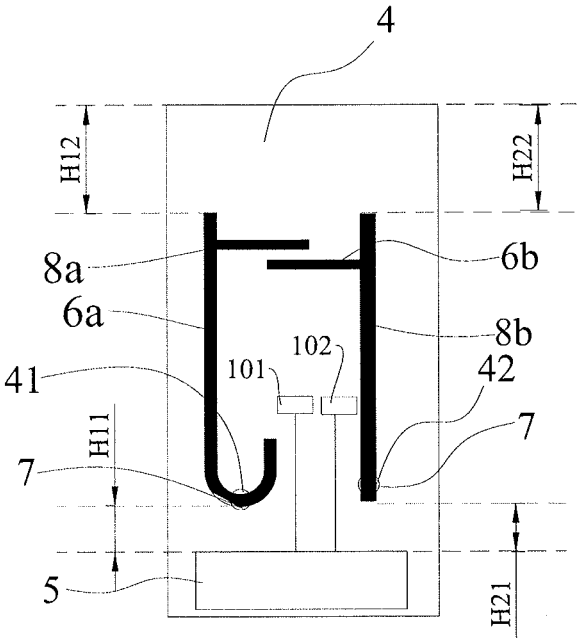
FIGS. 21A-21B are schematic views showing that the main antenna element is installed adjacent to the lower end of the main board, in which two backfire resonators constitute a backfire resonator array and the two backfire resonators are coupled by two multi-stage coupled metal conductors, and the main board feeds two backfire resonators which are both adjacent to the main antenna element through single feed coupling.
Figure 21B:
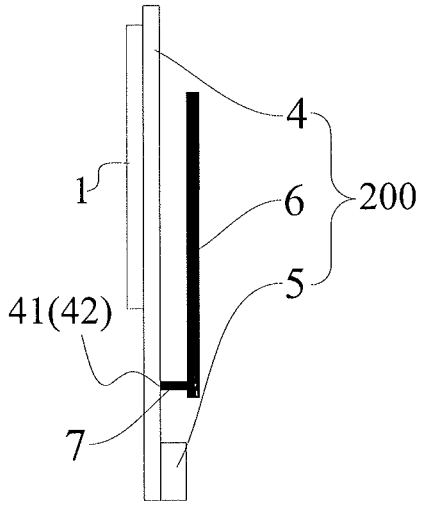

FIGS. 21A-21B show other embodiments of the present disclosure, the main antenna element 5 is disposed adjacent to a lower end of the main board 4. A first metal conductor 8*a* and a second metal conductor 8*b* coupled to each other are disposed between the first backfire resonator 6*a* and the second backfire resonator 6*b*. The first metal conductor 8*a* is connected to the first backfire resonator 6*a*, and the second metal conductor 8*b* is connected to the second backfire resonator 6*b*. The first distance H12 between an upper end of the first backfire resonator 6*a* and an upper end of the main board 4 is larger than that H11 between the main antenna element 5 and a lower end of the first backfire resonator 6*a*. The second distance H22 between an upper end of the second backfire resonator 6*b* and the upper end of the main board 4 is larger than that H21 between the main antenna element 5 and a lower end of the second backfire resonator 6*b*. The first and second backfire resonators 6*a*, 6*b* are fed respectively by the main board 4 from first and second positions 41, 42 on the main board adjacent to the lower end of the main board 4 through single feed coupling. In the embodiments shown in FIGS. 20A-20B, the first backfire resonator 6*a* and the second backfire resonator 6*b* may have shapes as those shown in FIGS. 16A-16B, 17A-17B, 18A-18B.

As described above, each of the first and second backfire resonators 6*a*, 6*b* may have a straight line shape, a T-shape, a triangular shape, a L-shape, a J-shape, a trapezoidal shape, an I-beam shape or theirs variants such as T, Ɜ, T, Y, Ξ, I, I, I, J, L, L, L.

Figure 23A:
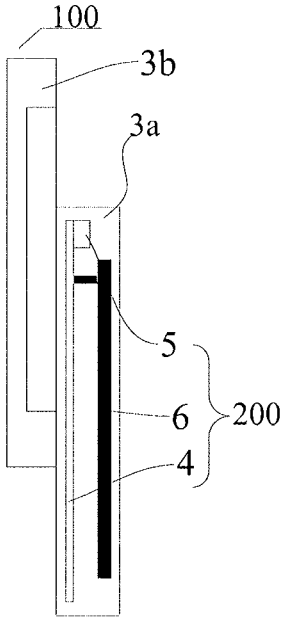
FIGS. 23A-23B are schematic views of a sliding cover cell phone according to another embodiment of the present disclosure, in which the main antenna element is disposed adjacent to the upper end of the shell.
Figure 23B:
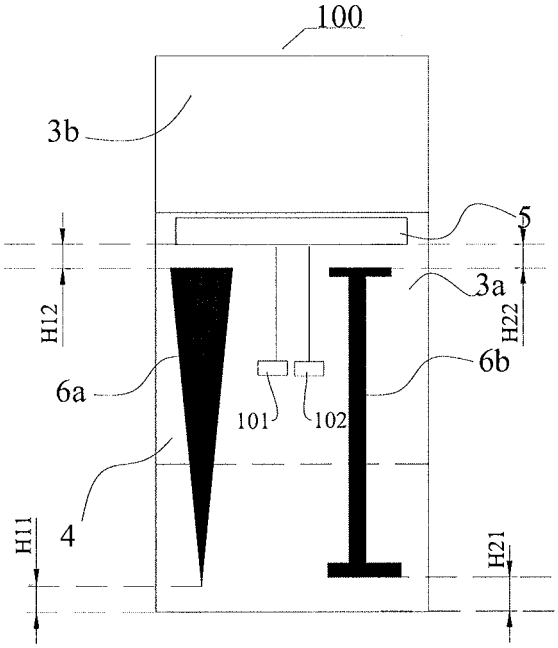

As described above, the main antenna element 5 is disposed adjacent to the lower end of the main board 4. However, the main antenna element 5 may be disposed adjacent to an upper end of the main board 4, as shown in FIGS. 23A-23B.

Figure 19A:
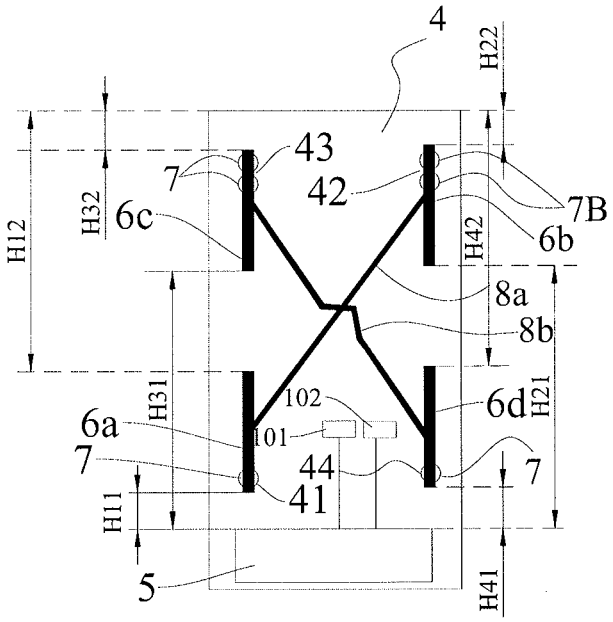
FIGS. 19A-19B are schematic views showing that the main antenna element is installed adjacent to the lower end of the main board, in which four backfire resonators in which every two connected to each other by a metal conductor constitute a backfire resonator array, in which the main board feeds two backfire resonators adjacent to the main antenna element through single feed coupling, and feeds the other two backfire resonators adjacent to the upper end of the main board through dual feed coupling.
Figure 19B:
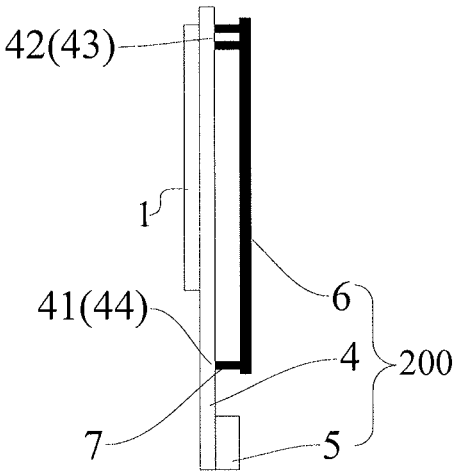

An embodiment in which four backfire resonators are provided to constitute a backfire resonator array will be described. As shown in FIGS. 19A-19B, the main antenna element 5 is disposed adjacent to a lower end of the main board 4, the backfire resonator array is located at a back side of the main board 4 in the shell 3 and comprises the first backfire resonator 6*a*, the second backfire resonator 6*b* , the third backfire resonator 6*c* and the fourth backfire resonator 6*d*.

The first backfire resonator 6*a* is connected to the second backfire resonator 6*b* by the first metal conductor 8*a*, and the third backfire resonator 6*c* is connected to the fourth backfire resonator 6*d* by the second metal conductor 8*b*.

A first distance H12 between an upper end of the first backfire resonator 6*a* and an upper end of the main board 4 is larger than that H11 between the main antenna element 5 and a lower end of the first backfire resonator 6*a*. A fourth distance H42 between an upper end of the fourth backfire resonator 6*d* and the upper end of the main board 4 is larger than that H41 between the main antenna element 5 and a lower end of the fourth backfire resonator 6*d*. Therefore, the first and fourth backfire resonators 6*a*, 6*d* are fed respectively by the main board 4 from first and fourth positions 41, 44 one the main board 4 adjacent to the lower end of the main board 4 through single feed coupling.

A second distance H22 between an upper end of the second backfire resonator 6*b* and the upper end of the main board 4 is smaller than that H21 between the main antenna element 5 and a lower end of the second backfire resonator 6*b*. A third distance H32 between an upper end of the third backfire resonator 6*c* and the upper end of the main board 4 is smaller than that H31 between the main antenna element 5 and a lower end of the third backfire resonator 6*c*. Therefore, the second and third backfire resonators 6*b*, 6*c* are fed respectively by the main board 4 from second and third positions 42, 43 on the main board 4 adjacent to the upper end of the main board 4 through dual feed coupling.

As mentioned above, the first metal conductor 8*a* and the second metal conductor 8*b* may be substituted by a plurality of metal conductors disconnected from each other and multistage-coupled.

In the embodiments as shown in FIGS. 19A-19B, the first to fourth backfire resonators 6*a*, 6*b*, 6*c* and 6*d* have a straight line shape. Alternatively, they may have any other suitable shapes such as the combination of the shapes mentioned above.

According to embodiments of the present disclosure, the metal conductor through which the backfire resonators 6 coupled to each others may have a straight line shape, a Z shape, a curved line shape or a zigzag shape.

According to embodiments of the present disclosure, the backfire resonators and the backfire resonator array constituted by backfire resonators are located in the shell. Alternatively, they may be disposed on the outside surface of the shell deviated from the user's head. This alternation is also within the scope of the present disclosure. It should consider the appearance of the cell phone when disposing the backfire resonator one the outside surface of the shell deviated from the user's head.

Figure 22A:
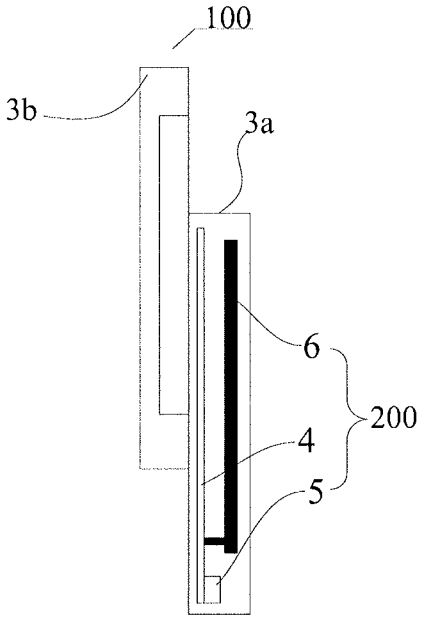
FIGS. 22A-22B are schematic views of a sliding cover cell phone according to an embodiment of the present disclosure, in which the main antenna element is disposed adjacent to the lower end of the shell.
Figure 22B:
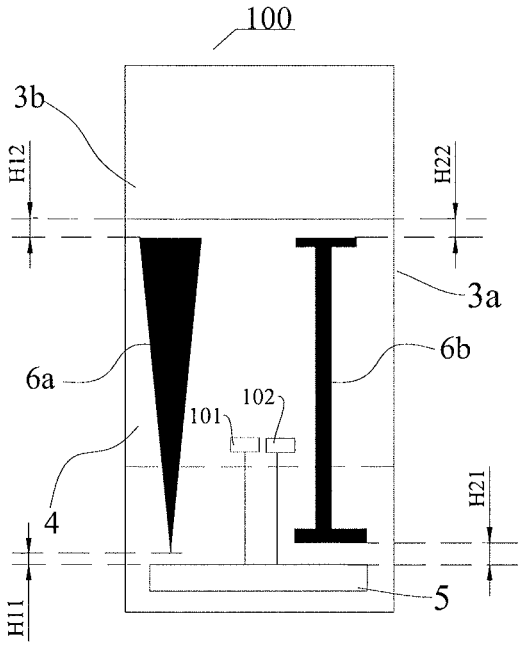

FIGS. 22A-22B shows a sliding cover phone 100 as an example of the present disclosure, the sliding cover phone 100 comprises a base shell 3*a* and a cover shell 3*b* slidable relative to the base shell 3*a*. As shown in FIGS. 22A-22B, the main antenna element 5 is disposed in the base shell 3*a* adjacent to a lower end of the base shell 3*a*. A backfire resonator array constituted by a first backfire resonator 6*a* and a second backfire resonator 6*b* is located at a back side of the main board 4 in the base shell 3*a*. The first backfire resonator 6*a* has a substantially triangular shape and the second resonator 6*b* has a substantially I-beam shape. A distance H11 between a lower end of the first backfire resonator 6*a* and the main antenna element 5 is smaller than a first distance H12 between an upper end of the first backfire resonator 6*a* and the upper end of the base shell 3*a*. A distance H21 between a lower end of the second backfire resonator 6*b* and the main antenna element 5 is smaller than a second distance H22 between an upper end of the second backfire resonator 6*b* and the upper end of the base shell 3*a*. The first backfire resonator 6*a* and the second backfire resonator 6*b* may be fed by the main board 4 from positions on the main board adjacent to the lower end of the main board 4 through capacitive coupling or single feed coupling.

FIGS. 23A-23B show variants of the examples shown in the FIGS. 22A-22B. In the examples shown in FIGS. 23A-23B, the main antenna element 5 is disposed in the base shell 3*a* adjacent to an upper end of the base shell 3*a*. A first distance H12 between an upper end of the first backfire resonator 6*a* and the main antenna element 5 is smaller than that H11 between the lower end of the first backfire resonator 6*a* and the lower end of the base shell 3*a*. A second distance H22 between an upper end of the second backfire resonator 6*b* and the main antenna element 5 is smaller than that H21 between a lower end of the second backfire resonator 6*b* and the lower end of the base shell 3*a*. The first backfire resonator 6*a* and the second backfire resonator 6*b* may be fed by the main board 4 from positions on the main board adjacent to the lower end of the main board 4 through capacitive coupling or single feed coupling.

Figure 24A:
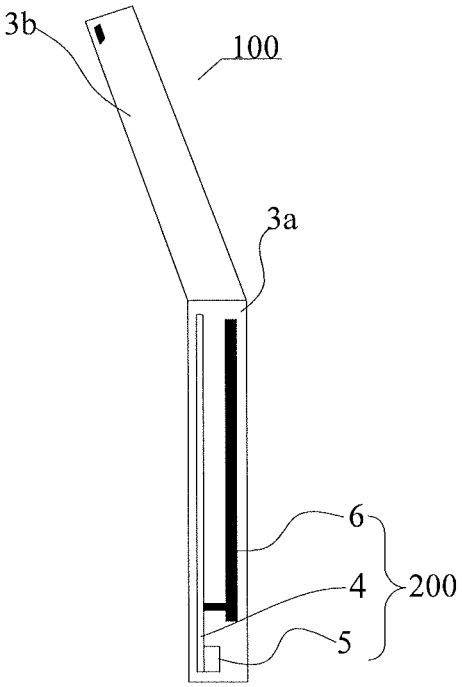
FIGS. 24A-24B are schematic views of a flip cover cell phone according to an embodiment of the present disclosure, in which the main antenna element is disposed adjacent to the lower end of the shell.
Figure 24B:
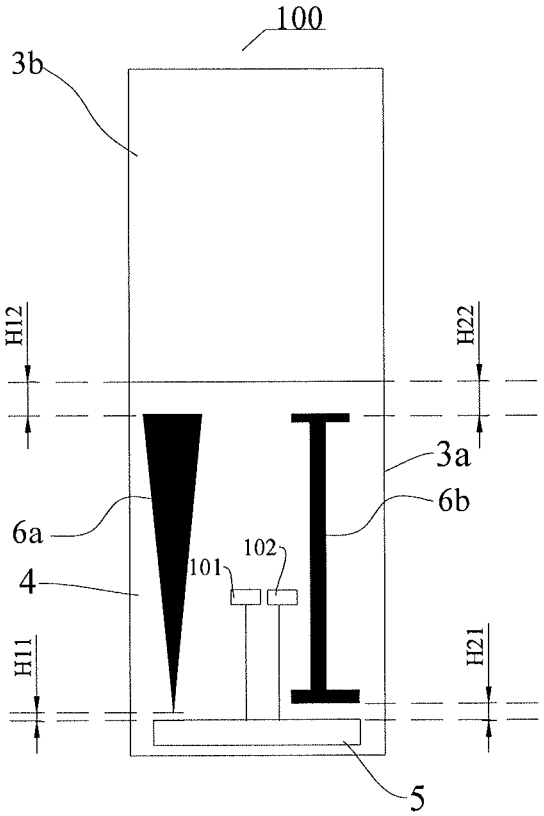

FIGS. 24A-24B shows a flip cover phone 100 as an example of the present disclosure, the flip cover phone 10 comprises a base shell 3*a* and a cover shell 3*b* pivotable relative to the upper end of the base shell 3*a*. The first backfire resonator 6*a* has a substantially triangular shape and the second resonator 6*b* has a substantially I-beam shape. A backfire resonator array constituted by the first backfire resonator 6*a* and the second resonator 6*b* is located at a back side of the main board 4 in the base shell 3*a*. The main antenna element 5 is disposed adjacent to a lower end of the base shell 3*a*. A distance H11 between a lower end of the first backfire resonator 6*a* and the main antenna element 5 is smaller than a first distance H12 between an upper end of the first backfire resonator 6*a* and the upper end of the base shell 3*a*. A sixth distance H21 between a lower end of the second backfire resonator 6*b* and the main antenna element 5 is smaller than a second distance H22 between an upper end of the second backfire resonator 6*b* and the upper end of the base shell 3*a*. The first backfire resonator 6*a* and the second backfire resonator 6*b* may be fed by the main board 4 from positions on the main board adjacent to the lower end of the main board 4 through capacitive coupling or single feed coupling.

Figure 25A:
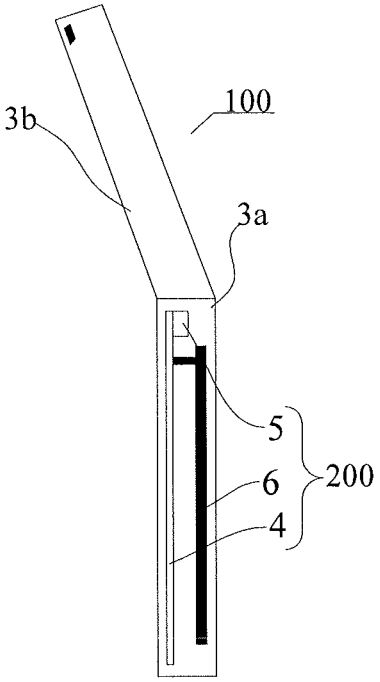
FIGS. 25A-25B are schematic views of a flip cover cell phone according to another embodiment of the present disclosure, in which the main antenna element is disposed adjacent to the upper end of the shell.
Figure 25B:
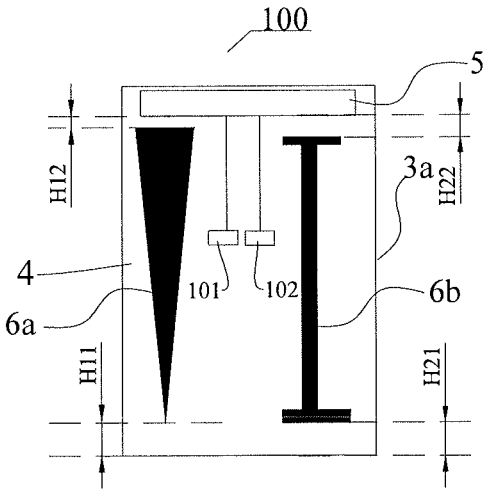

FIGS. 25A-25B show some variants of the examples shown in the FIGS. 24A-22B. In the examples shown in FIG. 25A-25B, the main antenna element 5 is disposed in the base shell 3*a* adjacent to an upper end of the base shell 3*a*. A first distance H12 between an upper end of the first backfire resonator 6*a* and the main antenna element 5 is smaller than that H11 between the lower end of the first backfire resonator 6*a* and the lower end of the base shell 3*a*. A second distance H22 between an upper end of the second backfire resonator 6*b* and the main antenna element 5 is smaller than that H21 between a lower end of the second backfire resonator 6*b* and the lower end of the base shell 3*a*. The first backfire resonator 6*a* and the second backfire resonator 6*b* may be fed by the main board 4 from positions on the main board adjacent to the lower end of the main board 4 through capacitive coupling or single feed coupling.

Therefore, according to embodiments of the present disclosure, by causing most electromagnetic waves of the mobile communication terminal to radiate towards the direction deviated from or turned aside from the user's head HD, the radiation and harm thereof to the user are reduced, the strength of the received signal is enhanced, and the communication quality is improved.

Although explanatory embodiments of the cell phone have been shown and described, it is known for those skilled that the mobile communication terminal of the present disclosure is not limited to the cell phone, for example the mobile communication terminal may be other wireless communication devices such as a personal digital assistant (PDA).

Although explanatory embodiments have been shown and described, it would be appreciated by those skilled in the art that changes, alternatives, and modifications can be made in the embodiments without departing from spirit and principles of the disclosure. Such changes, alternatives, and modifications all fall into the scope of the claims and their equivalents.

What is claimed is:

1. A mobile communication terminal, comprising:

an outer shell in the general form of a parallelepiped, and comprising at least a generally planar, generally rectangular back panel, and top, bottom, left side and right side panels defining an interior shell volume;

a substantially rectangular main board located within the interior shell volume and having a major back surface facing the interior of the back panel of the shell, and a major front surface opposite said major back surface, and top and bottom ends, respectively, adjacent said top and bottom panels of said shell;

said main board having a transmitting circuit and a receiving circuit thereon;

a main backfire antenna element adjacent to the bottom end of the main board, and coupled to the transmitting circuit and the receiving circuit; and a backfire resonator array located within the shell at the back surface of the main board and coupled to the main board and the main antenna element, whereby the backfire resonator array is fed by the main board from a position on the main board located away from the center of the main board, the backfire resonator array comprising first and second backfire resonators, a first distance between an upper end of the first backfire resonator and the top end of the main board is larger than a second distance between the main antenna element and a bottom end of the first backfire resonator, and a third distance between an upper end of the second backfire resonator and the top end of the main board is smaller than a fourth distance between the main antenna element and a lower end of the second backfire resonator, and the first backfire resonator is fed by the main board from a first position on the main board adjacent to the bottom end of the main board through capacitive coupling or single feed coupling, and the second backfire resonator is fed by the main board from a second position on the main board adjacent to the top end of the main board through a dual feed coupling.

2. The mobile communication terminal according to claim 1, wherein the backfire resonator array comprises a plurality of multistage-coupled conductors.

3. The mobile communication terminal according to claim 1, wherein the first and second backfire resonators are connected to each other by a metal conductor or by a plurality of multistage-coupled metal conductors located between the first and second backfire resonators.

4. The mobile communication terminal according to claim 1, wherein the backfire resonator array comprises first, second, third and fourth backfire resonators.

5. The mobile communication terminal according to claim 4, wherein a fourth distance between an upper end of the fourth backfire resonator and the top of the main board is larger than a distance between the main antenna element and a lower end of the fourth backfire resonator, wherein a third distance between an upper end of the third backfire resonator and the top end of the main board is smaller than a distance between the main antenna element and a lower end of the third backfire resonator, and wherein the fourth backfire resonator is fed by the main board from a fourth position on the main board adjacent to the bottom end of the main board, through capacitive coupling or single feed coupling, and the third backfire resonator is fed by the main board from a third position on the main board adjacent to the top end of the main board through dual feed coupling.

6. The mobile communication terminal according to claim 4, wherein the first and second backfire resonators are connected to each other by a first metal conductor, or by a plurality of first multistage-coupled metal conductors located between the first and second backfire resonators, and wherein the third and fourth backfire resonators are connected to each other by a second metal conductor, or coupled by a plurality of second multistage-coupled metal conductors located between the third and fourth backfire resonators.

7. The mobile communication terminal according to one of claims 1 and 4, wherein the backfire resonator has a shape selected from the group consisting of: a straight line shape, a T-shape, a triangular shape, an L-shape, a J-shape, a trapezoidal shape, and an I-beam shape.

8. The mobile communication terminal according to one of claims 3 and 6, wherein the metal conductor has a shape selected from the group consisting of: a straight line shape, a Z shape, a curved line shape, and a zigzag shape.

* * * * *